US005800134A

United States Patent [19]

Hasegawa et al.

[11] Patent Number: 5,800,134

[45] Date of Patent: Sep. 1, 1998

[54] TANDEM, SWASH PLATE PUMP HAVING DRIVE FORCE TAKE-OUT MECHANISM

[75] Inventors: Susumu Hasegawa, Kobe; Shoji Nakagaki, Kakogawa; Tokihiko Umeda, Kobe, all of Japan

[73] Assignee: Kawasaki Jukogyo Kabushiki Kaisha, Hyogo, Japan

[21] Appl. No.: 756,168

[22] Filed: Nov. 25, 1996

Related U.S. Application Data

[63] Continuation-in-part of Ser. No. 454,078, May 30, 1995, abandoned.

[30] Foreign Application Priority Data

Oct. 24, 1994 [JP] Japan ..... 6-284173

[51] Int. Cl.[6] ..... F04B 1/12

[52] U.S. Cl. ..... 417/269; 417/238; 74/15.86

[58] Field of Search ..... 417/350, 199.1, 417/238, 269, 360, 429; 74/15.86

[56] References Cited

U.S. PATENT DOCUMENTS

| | | | |
|---|---|---|---|
| 2,914,219 | 11/1959 | Chiantelassa | 417/429 |
| 3,132,533 | 5/1964 | Baker | 74/15.86 |
| 4,216,684 | 8/1980 | Hagin et al. | 74/15.86 |
| 4,534,271 | 8/1985 | Forster | 91/472 |
| 5,540,563 | 7/1996 | Hansell | 417/269 |

FOREIGN PATENT DOCUMENTS

| | | | |
|---|---|---|---|
| 707961 | 4/1965 | Canada | 74/15.86 |
| 3 324 583 A | 1/1984 | Germany . | |
| SHO 54-21803 | 2/1979 | Japan . | |

*Primary Examiner*—Timothy Thorpe
*Assistant Examiner*—Cheryl J. Tyler
*Attorney, Agent, or Firm*—Marshall, O'Toole, Gerstein, Murray & Borun

[57] ABSTRACT

A tandem, swash plate-type hydraulic pump in which a drive force transmission system for extending one or more hydraulic pumps and a structure relating to the system can be made simple and light, and one or more hydraulic pumps even when extended can be compactly arranged without increasing the axial length of the pump unit. A drive force take-out mechanism for taking outward part of a driving force out of a spline sleeve member of a spline coupling which is an intermediate coupling of a tandem, swash plate-type hydraulic pump. A first gear is connected with a spline sleeve member and a gear box. The gear box is composed of an intermediate gear, a driven gear, a spline sleeve member, and a gear case for rotatably housing these components. The gear box is removably fixed to an intermediate block and provided on both surfaces of the gear case are pump mounting portions for mounting hydraulic pumps which may be added as appropriate. Suction and discharge channels are disposed vertically in the mounting direction of the drive force take-out mechanism.

6 Claims, 4 Drawing Sheets

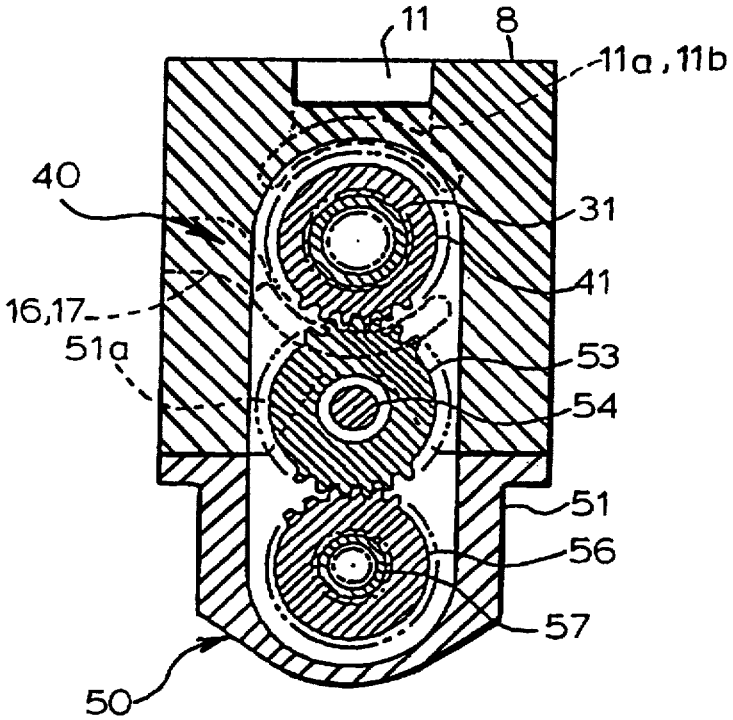
FIG. 2
FIG. 3
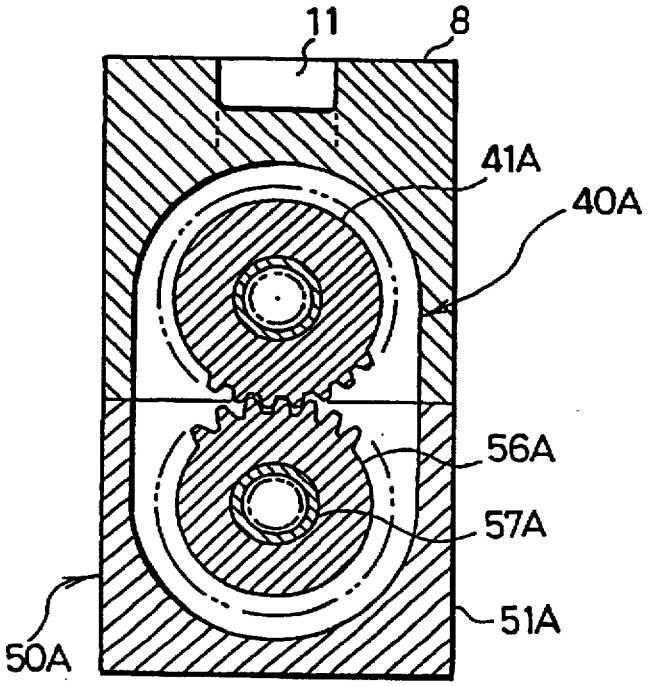

TANDEM, SWASH PLATE PUMP HAVING DRIVE FORCE TAKE-OUT MECHANISM

This is a continuation-in-part of application Ser. No. 08/454,078 filed May 30, 1995 abandoned.

TECHNICAL FIELD

The present invention relates to a tandem, swash plate-type hydraulic pump and, more particularly, to the same whose structure is improved to enable one or more hydraulic pumps to be added-on.

BACKGROUND OF THE INVENTION

Heretofore, swash plate-type hydraulic pumps have been widely used for the hydraulic pressure supply source in construction equipment and the like, and as a pump unit in which two swash plate-type hydraulic pumps are unitized. Presently there is utilized a parallel, swash plate-type hydraulic pump in which two swash plate-type hydraulic pumps are arranged in parallel with each other, and a tandem, swash plate-type hydraulic pump in which two swash plate-type hydraulic pumps are connected in series with each other. The parallel, swash plate-type hydraulic pump has several disadvantages in that a gear system required for interlocking the driving shafts of the two pumps becomes large, and at the same time, a torque loss results due to the agitation or vibration of the gear and a resulting heat problem, and that the width perpendicular to the axis of the pump unit becomes large. The tandem, swash plate-type hydraulic pump (though the axial length thereof becomes large) has an advantage in that the driving shafts of the two pumps can be interlocked through a spline coupling, so that the pump has a simple interlocking mechanism, can be made compact as a whole, and has less torque loss, thereby the tandem pump is widely applied.

A variety of construction equipment and the like are equipped with a plurality of hydraulic actuators other than traveling hydraulic motors and turning hydraulic motors, and many parallel, swash plate-type hydraulic pumps and tandem, swash plate-type hydraulic pumps are extended or added-on with one or more gear pumps to generate hydraulic pressure. For example, Japanese Laid-Open Utility Model SHO 54-21803 describes a parallel, swash plate-type hydraulic pump in which extended or added-on hydraulic pumps are connected in series with an input side and the opposite side of one swash plate-type hydraulic pump of the pump.

As shown in FIG. 5 as a first prior art example in a case where said tandem, swash plate-type hydraulic pump is extended with one or more add-on hydraulic pumps, a tandem, swash plate-type hydraulic pump 100 is provided on the input side thereof with a gear box 101 containing three gears, which transmits a driving force from a driving gear 103 rotating integrally with a driving shaft 102, into which the driving force is coupled, to gears 104, 105 on opposite sides thereof. The input driving force from drive shaft 102 is applied through the gear 104 into the tandem, swash plate-type hydraulic pump 100, and also through the gear 105 into one or more extended or addon hydraulic pumps 106.

As shown in FIG. 6 as a second prior art example is a case where the tandem, swash plate-type hydraulic pump 100 is extended with one or more hydraulic pumps, so that the tandem, swash plate-type hydraulic pump 100 is connected on a side opposite to the input side thereof in series with three extended or add-on hydraulic pumps 107 through 109, into which a driving force is coupled from the drive shaft of the tandem, swash plate-type hydraulic pump 100.

The case of the first prior art example shown in the above-mentioned FIG. 5 has several disadvantages. In order to transmit the driving force to a tandem, swash plate-type hydraulic pump having a large capacity, the dimensions of the gear box gears and of a gear case become large; the pump unit becomes large in size due to the axial length of the gear box; the gear box becomes large in size causing manufacturing costs thereof to become expensive and also the weight thereof to become heavy; and the agitation or vibration of the large gear causes a large torque loss, generates undesired heat and results in a reduced efficiency.

The case of the second example shown in the above-mentioned FIG. 6 also has some disadvantages. The tandem, swash plate-type hydraulic pump is connected in series with a plurality of extended or add-on hydraulic pumps which causes the axial length of the pump unit to become large, and as a result, a layout of the pump becomes restricted when installed in construction equipment.

It is desired therefore to provide a tandem, swash plate-type hydraulic pump in which a driving force transmission system for extending or adding on one or more hydraulic pumps and a structure relating to the system can be readily constructed and be lightweight, and so that one or more hydraulic pumps even when extended or added-on can be compactly arranged without increasing the axial length of the pump unit.

Furthermore, in normal prior art configurations of a swash plate-type hydraulic pump incorporating a drive force take-out mechanism (as for instance in U.S. Pat. No. 4,534,271) the semi-circular openings of a suction channel and a discharge channel are in the horizontal direction (see FIG. 2 of U.S. Pat. No. 4,534,271), so that as the swash plate is inclined vertically forward and backward the drive shaft is also vertically deflected in the direction of inclination of the swash plate. Accordingly, as the swash plate is inclined vertically forward and backward, the drive force take-out mechanism driving gear is moved vertically towards and apart from an intermediate gear which causes gear noise, abnormal gear wear and damage, and reduces the life of the gears.

SUMMARY OF THE INVENTION

The tandem, swash plate-type hydraulic pump of the present invention includes at least two swash plate-type hydraulic pumps which are connected in series, i.e., coaxial to each other, wherein the pump is provided with a driving force take-out mechanism for taking outward part of a driving force out of an intermediate coupling for connecting driving shafts of the above-mentioned two swash plate-type hydraulic pumps to each other.

The drive force take-out mechanism is mounted in the orthogonal direction with respect to the direction of inclination of the swash plate. In particular, semi-circular openings of a suction channel and a discharge channel are provided vertically in the mounting direction of the drive force take-up member, so the direction of swash plate inclination is horizontal and the direction of deflection of the driving shaft caused by the inclination of the swash plate is also horizontal. Accordingly, a driving gear in the take-out mechanism moves horizontally in response to deflection of the driving shaft, thereby significantly reducing the amount of movement of the driving gear towards and away from an intermediate gear in response to driving shaft deflection so as to reduce gear wear and gear noise and extend the life of the gears.

The tandem, swash plate-type hydraulic pump according to another embodiment of the invention includes at least two swash plate-type hydraulic pumps which are connected in series to each other, wherein the pump includes a spline coupling for connecting driving shafts of the above-mentioned two swash plate-type hydraulic pumps to each other; a first gear rotating integrally with a spline sleeve member of the above-mentioned spline coupling; and a gear box having a driven gear engaged with the above-mentioned first gear, a driving force take-out member rotating integrally with the driven gear, and a gear case for housing rotatably the driven gear and the driving force take-out member, the gear box being fixed removably to a housing of the tandem, swash plate-type hydraulic pump.

The tandem, swash plate-type hydraulic pump according to still another embodiment of the invention includes at least two swash plate-type hydraulic pumps which are connected in series to each other, wherein the pump includes a spline coupling for connecting driving shafts of the above-mentioned two swash plate-type hydraulic pumps to each other; a first gear rotating integrally with a spline sleeve member of the above-mentioned spline coupling; and a gear box having an intermediate gear engaged with the above-mentioned first gear and a driven gear engaged with the intermediate gear, a driving force take-out member rotating integrally with the driven gear, and a gear case for rotatably housing the intermediate gear, the driven gear and the driving force take-out member, the gear box being removably fixed to a housing of the tandem, swash plate-type hydraulic pump.

The tandem, swash plate-type hydraulic pump according to the last two mentioned embodiments is provided wherein the above-mentioned driving force take-out member comprises a spline sleeve member splinedly connected to the driven gear.

The tandem, swash plate-type hydraulic pump according to the last two mentioned embodiments is provided wherein pump mounting portions for mounting extended or add-on hydraulic pumps are provided on both respective end faces perpendicular to the axial center of the driven gear in the above-mentioned gear case.

The tandem, swash plate-type hydraulic pump according to still another embodiment of the invention is provided with a driving force take-out mechanism for taking outward part of a driving force out of an intermediate coupling for connecting driving shafts of the two swash plate-type hydraulic pumps to each other, so that with the driving force taken out by the driving force take-out mechanism, one or more hydraulic pumps separately extended can be driven.

The tandem, swash plate-type hydraulic pump according to a further embodiment of the invention is provided with a spline coupling for connecting driving shafts of the two swash plate-type hydraulic pumps to each other, with a first gear rotating integrally with a spline sleeve member of the spline coupling, and with a gear box removably fixed to a housing of the tandem. Rotatably housed in a gear case of the gear box are a driven gear engaged with the first gear, and a driving force take-out member rotating integrally with the driven gear.

Therefore, part of the driving force is transmitted from the spline coupling through the first gear to the driven gear, which can rotatably drive the driving force take-out member which in turn can drive one or more hydraulic pumps separately extended or added-on.

The tandem, swash plate-type hydraulic pump according to a further embodiment of the invention is provided with a spline coupling for connecting driving shafts of the two swash plate-type hydraulic pumps to each other, with a first gear rotating integrally with a spline sleeve member of the spline coupling, and with a gear box removably fixed to a housing of the tandem. Rotatably housed in a gear case of the gear box are an intermediate gear engaged with the first gear, a driven gear engaged with the intermediate gear, and a driving force take-out member rotating integrally with the driven gear.

Therefore, part of the driving force is transmitted from the spline coupling through the first gear and the intermediate gear to the driven gear, which can rotatably drive the driving force take-out member which in turn can drive one or more hydraulic pumps separately extended.

The tandem, swash plate-type hydraulic pump according to a further embodiment of the invention effects a function similar to an earlier mentioned embodiment, except that the above-mentioned driving force take-out member comprises a spline sleeve member splinedly connected to the driven gear, thereby readily providing a structure of connecting one or more hydraulic pumps separately extended to the driving force take-out member.

The tandem, swash plate-type hydraulic pump according to a further embodiment of the invention effects a function similar to that of an earlier mentioned embodiment, except that pump mounting portions for mounting extended hydraulic pumps are provided on both respective end faces perpendicular to the axial center of the driven gear in the gear case, whereby mounting the extended hydraulic pumps to these pump mounting portions allows one or more hydraulic pumps to be simply extended.

The various embodiments of the present invention provide significant resulting advantages over prior devices.

The tandem, swash plate-type hydraulic pump according to one embodiment of the invention is provided with a driving force take-out mechanism for taking outward part of a driving force out of an intermediate coupling for connecting driving shafts of the two swash plate-type hydraulic pumps to each other, so that with the driving force taken out by the driving force take-out mechanism, one or more hydraulic pumps separately extended can be driven.

Particularly, the driving force take-out mechanism is constructed so as to take outward part of a driving force out of the intermediate coupling, so that there are obtained several resulting advantages: (1) the driving force transmission system of the driving force take-out mechanism becomes relatively small in size; (2) the transmitted power is relatively small and a small-diameter rotating member can be applied, so that a torque loss due to agitation or vibration and heat loss becomes small; (3) advantages are thus obtained with respect to the manufacturing cost and weight of the driving force take-out mechanism and to energy saving (efficiency); (4) that where one or more hydraulic pumps are extended (or added-on) to be connected to the driving force take-out mechanism, the pump becomes compact as a whole without increasing the axial length of the tandem, swash plate-type hydraulic pump; (5) hydraulic pumps can be extended or added on both sides of the driving force take-out mechanism, which is advantageous where a plurality of hydraulic pumps is to be added-on; and (6) the amount of movement of the driving gear towards and away from the intermediate gear in response to driving shaft deflection is significantly reduced thereby reducing gear wear and gear noise and increasing the gear life.

The tandem, swash plate-type hydraulic pump according to another embodiment of the invention is provided with a spline coupling for connecting driving shafts of the two swash plate-type hydraulic pumps to each other, with a first gear rotating integrally with a spline sleeve member of the spline coupling, and with a gear box removably fixed to a housing of the tandem, swash plate-type hydraulic pump. Rotatably housed in a gear case of the gear box are a driven gear engaged with the first gear, and a driving force take-out member rotating integrally with the driven gear. Therefore, part of the driving force is transmitted from the spline coupling through the first gear to the driven gear, which can rotatably drive the driving force take-out member which in turn can drive one or more hydraulic pumps separately extended or added-on.

Part of the driving force of the spline coupling is taken out, so that there are obtained several resulting advantages: (1) the first gear and the driven gear require a relatively small size; (2) part of the housing of the tandem, swash plate-type hydraulic pump can be made effectively use of as part of the gear case, so that the gear case can be made small in size and weight; (3) the transmitted power is relatively small and a small-diameter rotating member can be applied, so that a torque loss due to agitation or vibration and heat loss becomes small; (4) advantages are thus obtained with respect to the manufacturing cost and weight of the driving force take-out mechanism and to energy saving (efficiency); (5) where one or more hydraulic pumps are extended to be connected to the driving force take-out mechanism, the first gear can be disposed by making effective use of the space in the tandem, swash plate-type hydraulic pump without increasing the axial length of the tandem, so that the pump becomes compact as a whole; (6) hydraulic pumps can be extended or added on both axial sides of the driving force take-out mechanism, which is advantageous for an extension of a plurality of hydraulic pumps; and (7) the gear box is removably fixed, so that the gear box can be optionally installed.

The tandem, swash plate-type hydraulic pump according to another embodiment of the invention is provided with a spline coupling for connecting driving shafts of the two swash plate-type hydraulic pumps to each other, with a first gear rotating integrally with a spline sleeve member of the spline coupling, and with a gear box fixed removably to a housing of the tandem, swash plate-type hydraulic pump. Rotatably housed in a gear case of the gear box are an intermediate gear engaged with the first gear, a driven gear engaged with the intermediate gear, and a driving force take-out member rotating integrally with the driven gear. Therefore, part of the driving force is transmitted from the spline coupling through the first gear and the intermediate gear to the driven gear, which can rotatably drive the driving force take-out member which in turn can drive one or more hydraulic pumps separately extended.

Part of the driving force of the spline coupling is taken out and the intermediate gear is provided, so that there are obtained several resulting advantages: (1) the first gear, the intermediate gear and the driven gear require a relatively small size; (2) part of the housing of the tandem, swash plate-type hydraulic pump can be made effectively use of as part of the gear case, so that the gear case can be made small in size and weight; (3) the transmitted power is relatively small and a small-diameter rotating member can be applied, so that a torque loss due to agitation or vibration and heat loss becomes small; (4) advantages are thus obtained with respect to the manufacturing cost and weight of the driving force take-out mechanism and to energy saving (efficiency); (5) where one or more hydraulic pumps are extended or added-on and to be connected to the driving force take-out mechanism, most of the first gear and the intermediate gear can be disposed by making effective use of the space in the tandem, swash plate-type hydraulic pump without increasing the axial length of the tandem, so that the pump becomes compact as a whole; (6) hydraulic pumps can be extended or added on both axial sides of the driving force take-out mechanism, which is advantageous for an extension of a plurality of hydraulic pumps; and (7) the gear box is removably fixed, so that the gear box can be optionally installed.

The tandem, swash plate-type hydraulic pump according to still another embodiment of the invention effects a function similar to that described above, except that the above-mentioned driving force take-out member comprises a spline sleeve member splinedly connected to the driven gear, thereby readily enabling a structure of connecting one or more hydraulic pumps separately extended or added-on to the driving force take-out member.

The tandem, swash plate-type hydraulic pump according to a further embodiment of the invention effects a function similar to that described above, except that pump mounting portions for mounting extended hydraulic pumps are provided on both respective end faces perpendicular to the axial center of the driven gear in the gear case, whereby mounting the extended hydraulic pumps to these pump mounting portions allows one or more hydraulic pumps to be simply extended.

BRIEF DESCRIPTION OF THE DRAWINGS

The features of this invention which are believed to be novel are set forth with particularity in the appended claims. The invention may be best understood by reference to the following description taken in conjunction with the accompanying drawings, in which like reference numerals identify like elements in the several figures and in which:

FIG. 2 is a sectional view taken on line II—II of FIG. 1;

FIG. 3 is a view similar to FIG. 2, showing a driving force take-out mechanism in accordance with an alternative embodiment;

DETAILED DESCRIPTION

With reference to the drawings, embodiments of the present invention will be explained hereinafter.

This embodiment is an example in a case where the present invention is applied to tandem, swash plate-type hydraulic pumps installed in construction equipment.

Figure 1:
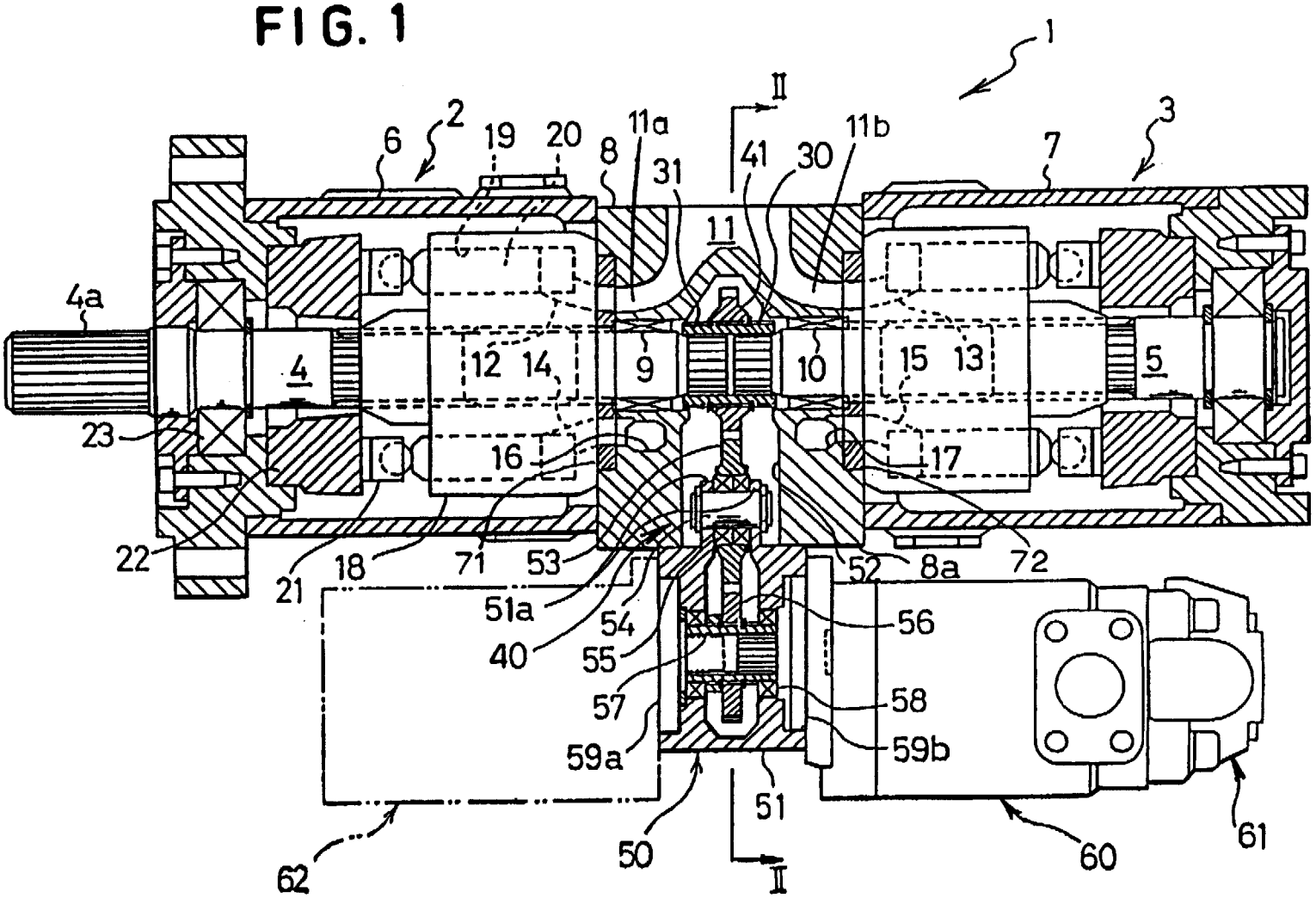
FIG. 1 is a partially broken sectional plan view of a tandem, swash plate-type hydraulic pump in accordance with one embodiment of the present invention and of a third and fourth hydraulic pumps extended.

As shown in FIG. 1, a tandem, swash plate-type hydraulic pump 1 is formed by connecting in series a first swash plate-type hydraulic pump 2 (hereinafter called the first hydraulic pump) to a second swash plate-type hydraulic pump 3 (hereinafter called the second hydraulic pump), in which an input portion 4*a* of a drive shaft 4 of the first hydraulic pump 2 is connected to an output shaft of an engine and driven by the engine.

A spline coupling 30 is provided as an intermediate coupling for connecting the rear end of the drive shaft 4 of the first hydraulic pump 2 to the front end of a drive shaft 5 of the second hydraulic pump 3.

A housing 6 of the first hydraulic pump 2 and a housing 7 of the second hydraulic pump 3 are integrally connected through an intermediate block 8 to each other. The rear end of the drive shaft 4 of the first hydraulic pump 2 and the front end of the drive shaft 5 of the second hydraulic pump 3 are supported through bearings 9, 10 by the intermediate block 8. Formed in the intermediate block 8 is a suction opening 11 leading to suction ports 12, 13 of both the hydraulic pumps 2, 3. Also formed in the intermediate block 8 are mutually-independent discharge openings 16, 17 leading to discharge ports 14, 15 of both the hydraulic pumps 2, 3.

The first hydraulic pump 2 is constructed such that provided in the housing 6 is a cylinder block 18 rotating integrally with the drive shaft 4. The cylinder block 18 is formed with a plurality of cylinders 19. Each cylinder 19 is mounted with a piston 20 and shoes 21 connected to the heads of a plurality of pistons 20, which pistons are in sliding contact with a swash plate 22 fixed to the housing 6, whereby when the drive shaft 4 and the cylinder block 18 are rotatably driven, a plurality of pistons 20 are axially and reciprocally moved in the cylinders 19 to cause an oil sucked from the suction opening 11 and the suction port 12 to be pressurized in the cylinder 19 by the piston 20, and discharged through the discharge port 14 from the discharge opening 16. Valve plates 71, 72 are disposed on opposite sides of the intermediate block 8, and include a pair of semi-circular openings for connecting the semi-circular openings 11*a*, 11*b* of suction opening 11 with the suction ports 12, 13 and mutually independent discharge openings 16, 17 with discharge ports 14, 15.

Since the other structure of the first hydraulic pump 2 is well known, a detailed description thereof will be omitted. Reference numeral 23 designates a bearing. Since the second hydraulic pump is similar in structure to the first hydraulic pump 2, a description thereof will also be omitted.

As shown in FIGS. 1 and 2, as a drive force take-out mechanism 40 for taking outward part of a drive force out of a spline coupling 30, there are provided a first gear 41 rotating integrally with a spline sleeve member 31 of the spline coupling 30 and a gear box 50.

The above-mentioned gear box 50 includes structure which is rotatably housed in a gear case 51, including an intermediate gear 53 engaged with the first gear 41, a driven gear 56 engaged with the intermediate gear 53, a spline sleeve member 57 as a drive force take-out mechanism, and the like. The intermediate block 8 is formed on a side opposite to the suction opening 11 with a cavity 52 capable of housing gears, and the cavity 52 is opened toward the gear case side. The first gear 41 is outwardly inserted into the spline sleeve member 31 and splinedly connected to the spline sleeve member 31, while the front and rear ends of the first gear 41 are locked with a pair of stop rings.

As shown in FIG. 2, semi-circular openings of 11*a*, 11*b* and 16, 17 are disposed vertically in the mounting direction of the drive force take-up member 40. In this arrangement, the direction of swash plate inclination is horizontal, and the direction of deflection of the driving shaft caused by the inclination of the swash plate is also horizontal. The drive force take-up mechanism 40 is therefore mounted in an orthogonal direction with respect to the direction of inclination of the swash plate 22. By the deflection of the driving shaft, the gear 41 moves in the horizontal direction which is orthogonal to the mounting direction of the drive force take-up mechanism. Therefore, a variation of the distance between the gear 41 and the intermediate gear 53 is decreased within 0.05 range of the amount of the horizontal movement of the gear 41.

The above-mentioned gear case 51 is removably fixed by a plurality of bolts to a mounting surface 8*a* opposite the side of the suction opening 11 of the intermediate block 8, and formed integrally with a pair of front/rear plate-shaped pivotable supports 51*a* protruding into the cavity 52. The intermediate gear 53 is rotatably and pivotably supported through a bearing 55 by a forward and backward facing pivotable support shaft 54 supported by the plate-shaped pivotable support 51*a*.

The driven gear 56 is outwardly inserted into the spline sleeve member 57 supported rotatably through a bearing 58 by the gear case 51 and splinedly connected to the spline sleeve member 57. The front and rear ends of the driven gear 56 are locked with a pair of stop rings, and the spline sleeve member 57 is rotated integrally with the driven gear 56.

The front and rear ends of the abovementioned gear case 51 are provided with pump mounting portions 59*a*, 59*b* which are used for mounting hydraulic pumps additionally extended as appropriate and also for fitting the circular protrusion of hydraulic pumps extended. For this embodiment, the pump mounting portion 59*b* on the rear side is mounted with a third hydraulic pump 60 (an extended hydraulic pump) formed of a small-size gear pump, and the input portion of a drive shaft of the third hydraulic pump 60 is splinedly connected to the rear half portion of the spline sleeve member 57.

Further, the third hydraulic pump 60 is connected in series with a fourth hydraulic pump 61 (an extended hydraulic pump) formed of a small-size gear pump. As shown with double dotted line in FIG. 1, the pump mounting portion 59*a* on the front side is mounted also with a fifth hydraulic pump 62 (an extended hydraulic pump), thereby allowing the input portion of the drive shaft thereof to be splinedly connected to the front half portion of the spline sleeve member 57.

Since the first gear 41 is not always required to be splinedly connected to the spline sleeve member 31, the first gear 41 may be outwardly inserted into the spline sleeve member 31 and fixed with screws and the like, or may be constructed integrally with the spline sleeve member 31.

This also applies similarly to the driven gear 56, such that since the driven gear 56 is not always required to be splinedly connected to the spline sleeve member 57, the driven gear 56 may be outwardly inserted into the spline sleeve member 57 and fixed with screws and the like, or may also be constructed integrally with the spline sleeve member 57.

Further, instead of the spline sleeve member 57 as the drive force take-out member, a shaft-shaped member may be provided and connected through a shaft coupling with the input portion of the drive shaft of the third hydraulic pump 60.

The operation and resulting advantages of the tandem, swash plate-type hydraulic pump described previously will be explained.

The pump is constructed such that part of the drive force from the spline coupling 30 is taken out through the first gear 41 and the intermediate gear 53 to the driven gear 56 and the spline sleeve member 57, whereby the dimensions (particularly gear diameter and thickness) of the first gear 41, the intermediate gear 53 and the driven gear 56 can be made small. In addition, part of the intermediate block 8 is effectively made use of as part of the gear case thereby enabling the gear case 51 to be made small in size.

Specifically, most of the first gear 41 and the intermediate gear 53 can be disposed by effectively utilizing the space in the intermediate block 8, thereby enabling the volume of the gear box 50 extending from the housings 6, 7 to be made small. Thus, a small size of the first gear 41 and the gear box 50 can be achieved; an advantage is obtained with respect to energy saving (efficiency); and the manufacturing cost can be controlled to a lower value and a lightweight structure can be constructed.

The tandem, swash plate-type hydraulic pump 1 is constructed such that the drive force is taken out from the spline coupling 30 as the intermediate coupling by the first gear 41 and the gear box 50, so that the gear box 50 is positioned at a substantially intermediate position in the axial direction of the tandem, swash plate-type hydraulic pump 1. Therefore, even where one or more hydraulic pumps are extended or added on the pump mounting portions 59*a*, 59*b* of the gear case 51, the pump unit including the tandem, swash plate-type hydraulic pump 1 and the extended or addedon hydraulic pumps does not become large in the axial direction, and thus remains compact as a whole. Therefore, a desirable layout ability of the pump unit when installed in construction equipment can be realized.

As described previously, the gear box 50 is positioned at a substantially intermediate position in the axial direction of the tandem, swash plate-type hydraulic pump 1, and the pump mounting portions 59*a*, 59*b* are provided on both the axial ends of the gear case 51, so that hydraulic pumps can be extended or added on the respective pump mounting portions 59*a*, 59*b*, which is very advantageous when two or more hydraulic pumps are added.

Also, the gear case 51 is removably fixed to the intermediate block 8, so that only the tandem, swash plate-type hydraulic pump 1 requiring the drive force take-out mechanism 40 can be provided with the gear box 50.

Further, where the first gear 41 is splinedly connected to the spline sleeve member 31, for the tandem, swash plate-type hydraulic pump 1 not requiring the drive force take-out mechanism 40, the installation of the first gear 41 can be omitted. That is, the tandem, swash plate-type hydraulic pump 1 requiring the drive force take-out mechanism 40 and the tandem, swash plate-type hydraulic pump 1 not requiring the drive force take-out mechanism 40 can be made common in construction to each other.

Also, the gear box 50 is provided on a side opposite to the suction opening 11 in the intermediate block 8, so that the gear box 50 can be provided without interfering with the suction opening 11.

Other alternative embodiments in which the above-mentioned embodiment is partially modified will be explained hereinafter.

As shown in FIG. 3 similar to FIG. 2, in a drive force take-out mechanism 40A of an alternative embodiment, the above-mentioned intermediate gear 53 is omitted, and a first gear 41A and a driven gear 56A are made large in diameter to engage the first gear 41A with the driven gear 56A. That is, a gear box 50A is provided with the driven gear 56A engaged with the first gear 41A, with a spline sleeve member 57A as the drive force take-out member rotating integrally with the driven gear 56A, and with a gear case 51A for rotatably housing the driven gear 56A and the spline sleeve member 57A. In this case, the intermediate block 8 also becomes somewhat large, which is somewhat disadvantageous with respect to energy saving (efficiency). The remaining structure of this alternative embodiment is basically similar to the above-mentioned embodiment of FIG. 2.

Figure 4:
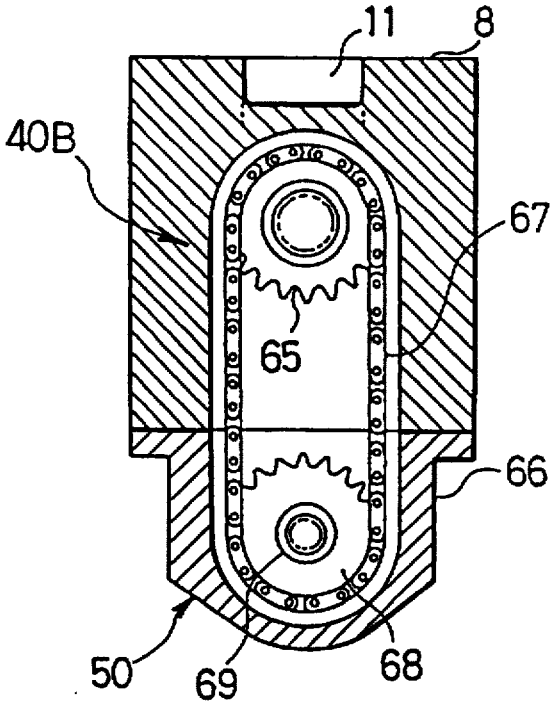
FIG. 4 is a view similar to FIG. 2, showing a driving force take-out mechanism in accordance with another alternative embodiment.
Figure 5:
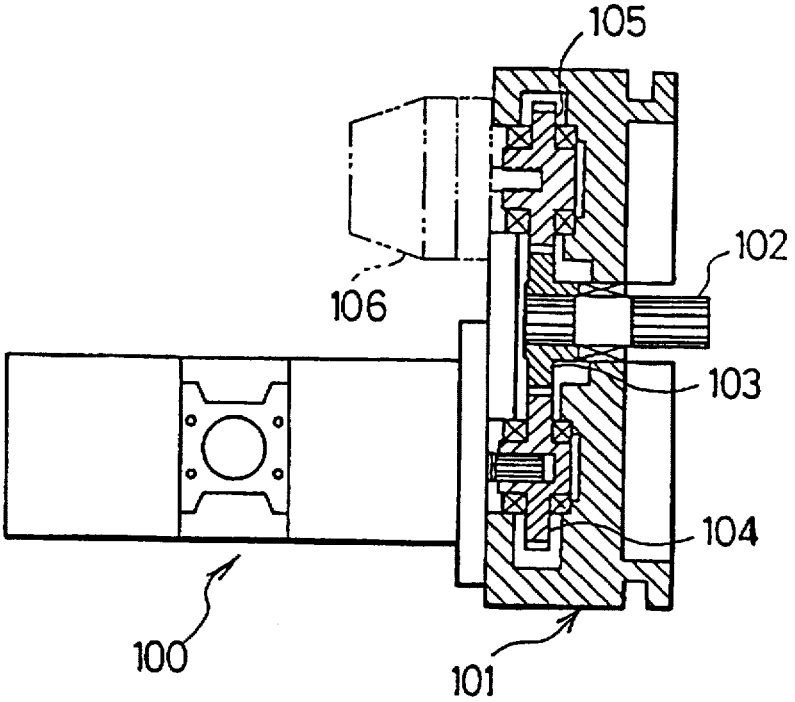
FIG. 5 PRIOR ART
FIG. 5 is a partially broken sectional plan view of a prior art tandem, swash plate-type hydraulic pump with a gear box.
Figure 6:
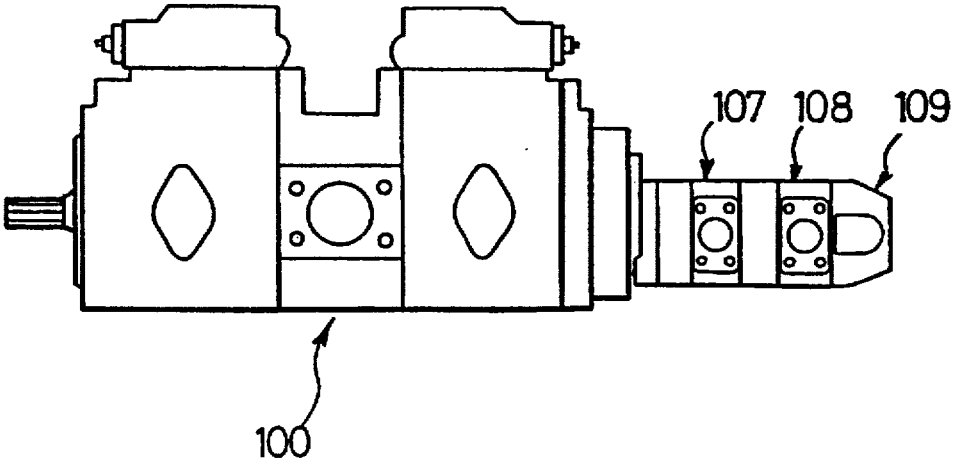
FIG. 6 PRIOR ART
FIG. 6 is a plan view of a pump unit including a prior art tandem, swash plate-type hydraulic pump with two hydraulic pumps extended.

As shown in FIG. 4 similar to FIG. 2, a drive force take-out mechanism 40B of an alternative embodiment is provided with a first sprocket 65 outwardly inserted into and fixed to the spline sleeve member 31 of the spline coupling 30. Rotatably housed in a sprocket case 66 equivalent to the above-mentioned gear case 51 is a second sprocket 68 connected interlockedly through a chain 67 to the first sprocket 65, and a forward and backward facing spline sleeve member 69. The sprocket case 66 is removably fixed by a plurality of bolts to the intermediate block 8 of the tandem, swash plate-type hydraulic pump 1.

As an alternative, there may be provided a first pulley instead of the first sprocket 65, a second pulley instead of the second sprocket 68, and a belt member instead of the chain 67. Then, the first pulley and the second pulley may be constructed of toothed pulleys, and the belt member be a timing belt.

The foregoing detailed description has been given for clearness of understanding only, and no unnecessary limitations should be understood therefrom, as modifications will be obvious to those skilled in the art.

What is claimed:

1. A tandem, swash plate-type hydraulic pump comprising:

at least two swash plate-type hydraulic pumps mounted in a housing and having respective drive shafts movable in response to swash plate inclinations;

a spline coupling including a rotatable spline sleeve member for connecting said drive shafts of said two swash plate-type hydraulic pumps coaxial to each other;

a first gear rotating integrally with said spline sleeve member of said spline coupling;

a gear box including a driven gear engaged with said first gear, a drive force take-out member rotating integrally with the driven gear, a gear case for rotatably housing the driven gear and the drive force take-out member, and means for removably mounting said gear box to said housing of the tandem, swash plate-type hydraulic pump; and means enabling said drive force take-out member mounted in an orthogonal direction with respect to the direction of inclination of said swash plate.

2. A tandem, swash plate-type hydraulic pump as set forth in claim 1, wherein said drive force take-out member includes a second spline sleeve member splinedly connected to said driven gear.

3. A tandem, swash plate-type hydraulic pump as set forth in claim 2, wherein said gear box has respective end faces, and including pump mounting portions for mounting add-on hydraulic pumps provided on said respective end faces perpendicular to the axial center of the driven gear in said gear case.

4. A tandem, swash plate-type hydraulic pump comprising:

a housing;

at least two swash plate-type hydraulic pumps mounted in said housing and having respective drive shafts movable in response to swash plate inclinations;

a spline coupling including a rotatable spline sleeve member for connecting said drive shafts of said two swash plate-type hydraulic pumps coaxial to each other;

a first gear rotating integrally with said spline sleeve member of said spline coupling;

a gear box including an intermediate gear engaged with said first gear and a driven gear engaged with the intermediate gear, a drive force take-out member rotating integrally with the driven gear, a gear case for rotatably housing the intermediate gear, the driven gear and the drive force take-out member, and means for removably mounting said gear box to said housing of the tandem, swash plate-type hydraulic pump; and means enabling said drive force take-out member mounted in an orthogonal direction with respect to the direction of inclination of said swash plate.

5. A tandem, swash plate-type hydraulic pump as set forth in claim 4, wherein said drive force take-out member includes a second spline sleeve member splinedly connected to said driven gear.

6. A tandem, swash plate-type hydraulic pump as set forth in claim 5, wherein said gear box has respective end faces, and including pump mounting portions for mounting add-on hydraulic pumps provided on said respective end faces perpendicular to the axial center of the driven gear in said gear case.

* * * * *